US005361956A

United States Patent [19]

Recanati

[11] Patent Number: 5,361,956

[45] Date of Patent: Nov. 8, 1994

[54] DEVICE FOR CARRYING OBJECTS WITH HANDLES

[76] Inventor: Maurice-André Recanati, 315 W. 70th St., New York, N.Y., 10023

[21] Appl. No.: 158,445

[22] Filed: Nov. 29, 1993

[51] Int. Cl.[5] ..... B65D 33/06

[52] U.S. Cl. ..... 224/257; 224/268; 294/159; 294/169

[58] Field of Search ..... 224/103, 915, 922, 257, 224/268, 270, 272; 248/100; 211/195, 12, 113; 24/597; 294/159, 169, 170, 137, 143, 142

[56] References Cited

U.S. PATENT DOCUMENTS

| | | | |
|---|---|---|---|
| 886,116 | 4/1908 | Custer | 211/113 |
| 2,659,122 | 11/1953 | Golubics | 24/597 |
| 4,063,646 | 12/1977 | Stahl, Jr. | 224/922 |
| 5,026,105 | 6/1991 | Feldman | 294/170 |

*Primary Examiner*—Henry J. Recla

*Assistant Examiner*—Steven O. Douglas

*Attorney, Agent, or Firm*—Marguerite Del Valle

[57] ABSTRACT

A portable device is disclosed which when placed on the shoulder enables the user to comfortably carry bags with handles and objects with hooked handles. This device comprises two rectangular shaped identical half-bars, each having a top section with an adjacent ledge portion (8) running along the length of the top section; a bottom section having a plurality of hooks (7) positioned along its length; a pivot end portion (10) with an aperture through which the two half-bars are connected, permitting the half-bars to be rotated from a folded position where the ledge of the first half-bar is parallel to the ledge of the second half-bar, to an open position where the ledge portion of the first half-bar forms a 180 degrees angle with the ledge portion of the second half-bar; and a strap end portion (6) through which a strap for carrying is attached.

14 Claims, 2 Drawing Sheets

DEVICE FOR CARRYING OBJECTS WITH HANDLES

FIELD OF THE INVENTION

The present invention relates to a strap supported plastic member or "bar" which facilitates the carrying of shopping bags and the like while leaving the hands free.

BACKGROUND OF THE INVENTION AND PRIOR ART

For centuries people have tried to devise means which would help them in the every day transport of heavy loads such as water, food and other necessities.

Even though many inventions were developed, starting with the basic stick holding a bag over the shoulder to more sophisticated devices, it is not uncommon to observe a great number of people who are still carrying, every day, their grocery bags, shopping bags, packages and the like by hand. This puts a burden on the fingers, strains the muscles of the wrists and arms, and ties up both hands making it very difficult to hold a banister, use stairs or open or close doors. Furthermore, a large segment of the population usually have already a hand tied up, for example, the professional holding an attache case, the student loaded with books, the elderly leaning on a cane. The need for a useful carrying device is, therefore, as acute now as it has ever been.

In this domain, all of the devices of the prior art are characterized by a strap type harness which fastens over the shoulders and by some type of hooks which are secured to the straps. Even though the harness is useful, since it allows the weight to be evenly distributed around the shoulders and neck, it is not readily accepted by consumers for practical, psychological and esthetic reasons.

U.S. Pat. No. 1,281,822 to Orr (1918) discloses a shoulder carrier for packages or containers which consists of a yoke, very similar in appearance to the harness worn by a horse, on and/or under which two large bags can be suspended. This device is cumbersome. The chains on which the hooked bags apply have to be arranged around the user's back, front and armpits. Moreover, the position of the hooks under the armpits creates a risk of injury to the user because they are bent towards the body. Furthermore, chains and hooks can easily rust and spoil the user's clothes.

U.S. Pat. No. 2,718,988 to Potts (1955) discloses a dual shoulder looped strap carrying means. The device consists mainly of straps which are threaded in front of the throat, around the neck and sit on the user's shoulders. The device requires some intricate manual assembly before use, and does not allow for the transportation of more than two packages at the same time.

Therefore, the invention described herein offers solutions to overcome the many drawbacks of previous carrying devices and displays a number of desirable features.

SUMMARY OF THE INVENTION

Several objects and advantages of the present invention are:

a) to provide a large carrying capacity device which allows the transportation of many bags.

b) to provide a collapsible device which is easily packed in a briefcase, hand-bag or even a deep pocket when not in use.

c) to provide a device which opens and closes in a snap and requires no manual assembly.

d) to provide a light-weight device.

e) to provide a stylish device because plastic can come in any fashionable color.

f) to provide a maintenance free device which will never rust.

g) to provide a safe device because of the direction of the hooks away from the user's body.

h) to provide a solid device produced by injection molding.

i) to provide a device inexpensive to manufacture.

j) to provide a versatile device which allows the user to carry not only shopping or grocery bags of all sizes, but also an umbrella or a hanger with clothes and/or a resting place for a cane.

k) to provide a device which is comfortable to wear because the carried items can be spaced and arranged along the bar by the user who may also adjust the shoulder padded strap to fit his needs.

l) to provide an elegant device which is appealing to the eye and socially acceptable.

These numerous advantages will be more fully appreciated from the following detailed description and the appended claims.

DETAILED DESCRIPTION OF THE INVENTION

Figures 1, 4, 7:
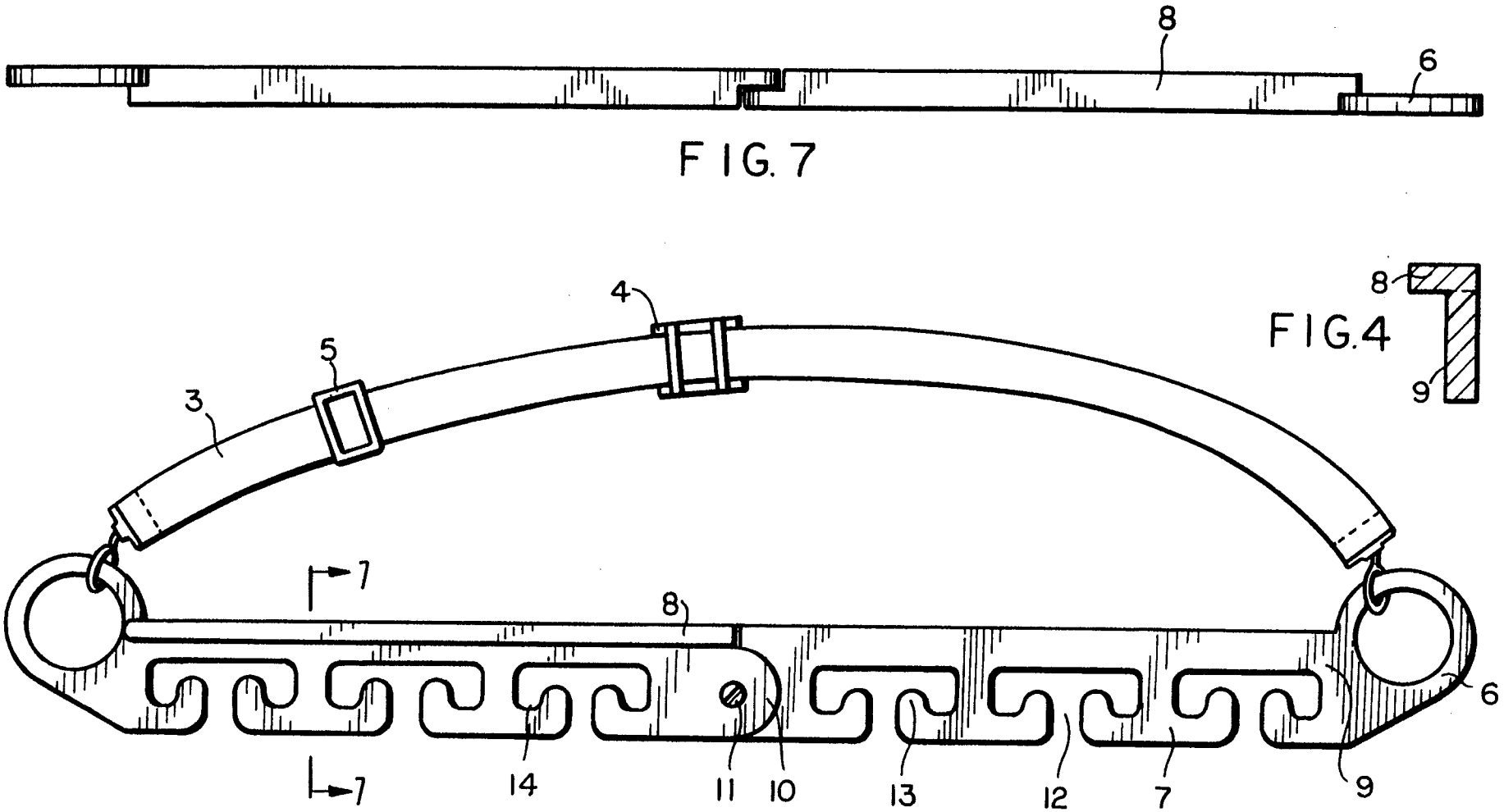
FIG. 1 is a front view of the carrying device shown in the opened position ready for use.
FIG. 4 is a cross sectional view taken along plane 1—1 as shown in FIG. 1, illustrating the L-cross sectional construction of the open bar.
FIG. 7 is a top view of the device in open position.

The present invention is shown in a front view on FIG. 1 in the general position that the device will assume while in use. The "bar" which is hung from one's shoulder by a strap 3 on which a pad 4 and a buckle 5 are attached, consists of two identical half-bars. The half-bar can be mass produced in a single injection molder, rendering the item inexpensive to manufacture. The two half-bars are secured together by a fastener, such as a screw, a rivet or an eyelet, which goes through an aperture on each of the half-bar central pivot point 11 and permits pivoting.

Figure 6:
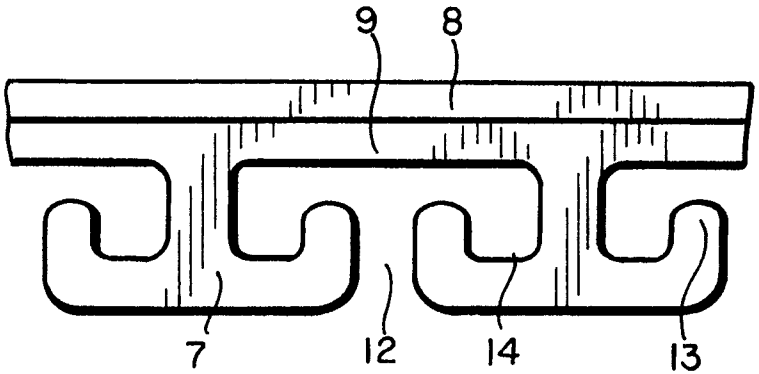
FIG. 6 is a detail view of two sets of integral hooks.

As shown, the bar is generally rectangular shaped and includes integral rings 6 at the ends as well as six to eight integral hooks 7 along the bar. The rings allow strap attachment and provide a place to hang items with hooked handles (such as umbrellas or camera clips). The integral hooks in sets of two are essentially carvings in the side of the bar. Each integral hook consists of two teeth 13 and two resting surfaces 14. The integral hooks are separated from each other by an insertion channel 12. As portrayed in FIG. 6, the insertion channel extends above the summit of the rounded tooth, which in turn is located above the resting surface. Since the resting surface is significantly recessed below the crest of the tooth, the weight of the attached object is sufficient to prevent it from climbing over the tooth and falling out. The user may thread a shopping bag handle or a coat hanger through the insertion channel and over any of the teeth before lowering the bag unto the resting surface. This operation may be carried out by using only one hand.

Figure 2:
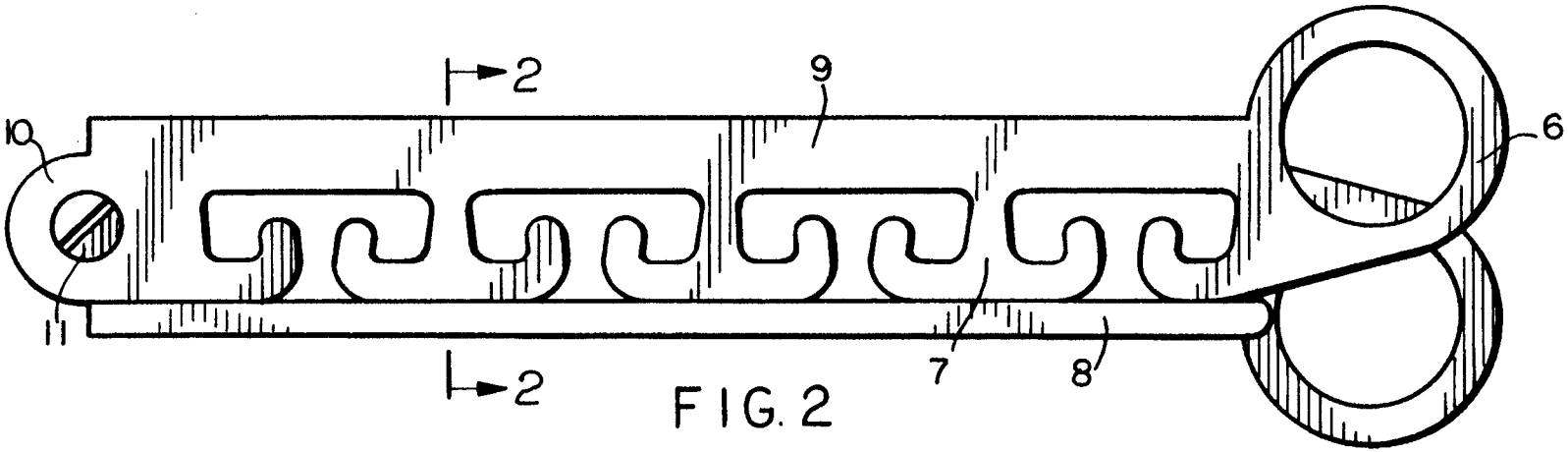
FIG. 2 is a front view of the device shown in the folded position when collapsed.

In the disclosed embodiment, as shown in FIG. 4, the shopping bag carrier has an L-beam cross sectional configuration which runs along most of its length. The smaller segment of the L shape is a ledge 8, the thickness of which should be approximately twice the thickness of the rings or of the hooks. The device may be dimensioned as desired but the preferred dimensions are as follows: the ledge thickness should be about ½ inch, while the thickness of the rings and hooks is about ¼ inch. When folded, as shown in FIG. 2, the dimensions of the bar, from the pivot end portion 10 to the rings 6, should not be more than 10 inches. The overall height of the bar when collapsed should be about 1 and ¾ inch, which renders the device very compact.

The aforementioned ledge 8 which runs lengthwise in each half-bar serves two purposes. Firstly, when the device is not in use, the two half bars may be folded in such a manner that the shorter segment of the L-cross section of one half bar protects and complements the integral hooks of the other half bar, as the integral hooks come to bump on the ledge when the bar is folded, as seen in FIG. 2. Secondly, the shorter segment of the L enters into play for the reaction torque system explained below.

Figure 3:
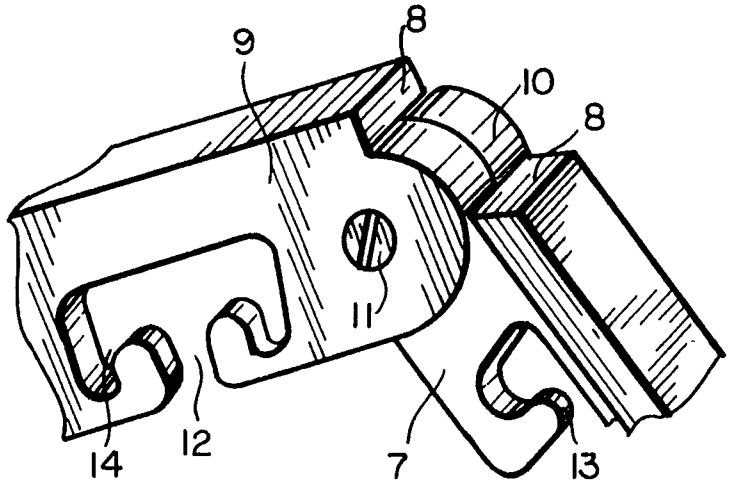
FIG. 3 is a perspective view of the locking mechanism of the device, illustrating the action of the two ledges on one another.
Figure 5:
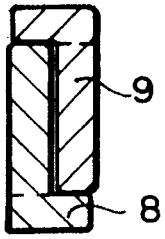
FIG. 5 is a cross sectional view taken along plane 2—2, as shown in FIG. 2, illustrating the interplay of the L-cross sectional configuration of each half-bar on the other.

When in use, the load, which is distributed along the length of the bar, is supported by the tips of the straps which are located on the integral rings at the ends of the bar. Although the two tips of the strap exert a force equal in magnitude and direction to the equivalent load, they each exert a higher torque relative to the central pivot 11 than the distributed load. The tendency for the device to want to "open" more is stopped by a design limitation, as can be seen in FIG. 3. The ledges, formed by the short side of the L cross section, touch each other when the bar is fully extended, as shown in FIG. 1 and FIG. 7, and prevent further opening of the device by withstanding high stresses and by producing a reaction torque.

Thus is provided an improved carrier device that fulfills the objects of the invention. While the invention is described in specific embodiments, many alternatives, modifications, and variations, which will be apparent to those skilled in the art, fall within the spirit and scope of the claims.

Now that I have described the invention, I claim:

1. A portable device comprising:

(a) a first and a second half-bar, each half-bar having
  (1) a substantially rectangular portion of a predetermined length having a top section forming a ledge portion and a bottom section, said bottom section having a plurality of hooks positioned substantially along the length of said rectangular portion,
  (2) a pivot end portion, having an aperture extending through said rectangular portion,
  (3) a strap end portion, having an opening, positioned on an opposite end of said rectangular portion with respect to the pivot end portion; and (b) means for connecting the pivot end portion of the first half-bar to the pivot end portion of the second half-bar extending through the apertures of each half-bars such that the half-bars can be rotated with respect to each other from a first position where the ledge portion of the first half-bar is parallel to the ledge portion of the second half-bar and where the ledge portion, of each half-bar is positioned adjacent to the bottom section of the other half-bar, to a second position where the ledge portion of the first half-bar is continuous with and forms a 180 degrees angle to the ledge portion of the second half-bar; and (c) a carrying means attached through the openings of the strap end portions of the first and second half-bars.

2. A device of claim 1 wherein the half-bars are produced by injection molding.

3. A device of claim 1 wherein the half-bars are composed of a general purpose polypropylene copolymer.

4. A device of claim 3 wherein color granules are incorporated into the copolymer prior to production.

5. A device of claim 1 wherein the half-bars are composed of a polycarbonate compound.

6. A device of claim 1 wherein the half-bars are composed of glass filled nylon.

7. A device of claim 1 wherein the half-bars are composed of metal.

8. A device of claim 1 wherein the means for connecting is a screw.

9. A device of claim 1 wherein the means for connecting is a metal rivet.

10. A device of claim 8 wherein the screw is of zinc plated steel.

11. A device of claim 1 wherein the width of the rectangular portion of the half-bar does not exceed 0.5 inch, the height of the half-bar does not exceed 1.75 inches, the length of the half-bar does not exceed 10 inches.

12. A device of claim 1 wherein said plurality of hooks is six.

13. A device of claim 1 wherein said plurality of hooks is eight.

14. A portable device comprising:

(a) a first and a second half-bar, each half-bar having
  (1) a substantially rectangular portion of a predetermined length having a top section forming a ledge portion and a bottom section, said bottom section having six hooks positioned substantially along the length of said rectangular portion
  (2) a pivot end portion, having an aperture extending through said rectangular portion,
  (3) a strap end portion, having an opening, positioned on an opposite end of said rectangular portion with respect to the pivot end portion; wherein the half-bars are produced by injection molding and the half-bars are composed of polypropylene into which color granules have been incorporated, (b) a rivets connecting the pivot end portion of the first-half bar to the pivot end portion of the second half-bar extending through the apertures of the first half-bar and the second half-bar such that the half-bars can be rotated with respect to each other from a first position where the ledge portion of the first half-bar is parallel to the ledge portion of the second half-bar and where the ledge portion of each half-bar is positioned adjacent to the bottom section of the other half-bar, to a second position where the ledge portion of the first half-bar is continuous with and forms a 180 degrees angle to the ledge portion of the second half-bar; and (c) a carrying means attached through the openings of the strap end portions of the first and second half-bars.

* * * * *